US006397743B1

(12) United States Patent
Dauer et al.

(10) Patent No.: US 6,397,743 B1
(45) Date of Patent: Jun. 4, 2002

(54) PRINTING UNIT

(75) Inventors: Horst Dauer, Rohrbach; Josef Göttling, Friedberg; Godber Petersen, Augsburg, all of (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 09/634,394

(22) Filed: Aug. 9, 2000

(30) Foreign Application Priority Data

Aug. 10, 1999 (DE) ..... 199 37 795
Feb. 23, 2000 (DE) ..... 100 08 225

(51) Int. Cl.[7] ..... B41F 5/00

(52) U.S. Cl. ..... 101/220; 101/247; 101/479; 101/480

(58) Field of Search ..... 101/212, 216, 101/217, 218, 247, 182, 184, 185, 479, 480, 219, 220

(56) References Cited

U.S. PATENT DOCUMENTS 5,063,844 A 11/1991 Fausel
5,806,427 A * 9/1998 Niemiro et al. ..... 101/247
5,868,071 A * 2/1999 Niemiro et al. ..... 101/218
6,085,650 A * 7/2000 Petersen ..... 101/220

FOREIGN PATENT DOCUMENTS

| | | |
|---|---|---|
| CH | 588 942 | 6/1977 |
| DE | 645 820 | 6/1937 |
| DE | 195 34 651 A1 | 3/1997 |
| DE | 196 24 395 A1 | 1/1998 |
| DE | 198 05 898 A1 | 11/1999 |
| DE | 199 19 732 A1 | 11/1999 |
| FR | 2 535 651 | 5/1984 |
| WO | WO 99/10176 | 3/1999 |

* cited by examiner

*Primary Examiner*—Ren Yan
(74) *Attorney, Agent, or Firm*—Cohen, Pontani, Lieberman & Pavane

(57) ABSTRACT

A printing unit for a web-fed rotary printing machine is provided having at least one carrying wall, a plurality of cylinders mounted on the carrying wall, a drive motor corresponding to each cylinder and a slide corresponding to each cylinder. Each slide carries its corresponding cylinder and receives the corresponding drive motor. A drive means is provided for driving the slides and a plurality of guide elements are mounted on the carrying wall and arranged laterally next to the adjacent end faces of the cylinders for guiding the slides along the wall. The guide elements are arranged opposite and parallel to one another on the carrying wall. Optionally, the carrying wall includes panels defining an orifice to allow cylinders, journals and sleeves of the printing machine of varying sizes to be changed readily.

27 Claims, 5 Drawing Sheets

28
1
16
17
20
24
15
11
5
9
25
21
14
14
12
13
10
29
1
37

PRINTING UNIT

BACKGROUND OF THE INVENTION

1. Field of the Invention

The present invention relates to a printing unit for a web-fed rotary printing machine. More particularly, the present invention is a printing unit which allows cylinders, journals and sleeves of varying sizes to be readily changed on the printing machine.

2. Description of the Related Art

German reference No. DE 195 34 651 A1 discloses a printing unit having two stand walls running parallel to the end faces of the printing unit cylinders. The printing unit cylinders can be equipped with sleeves of different diameter, so that the length of the printing image can be changed. A slide is provided on the stand walls on both sides of the printing unit cylinder to mount the ends of a printing unit cylinder. The slides are adjustable by means of working cylinders operated with a pressure medium. This design entails a relatively complicated construction.

SUMMARY OF THE INVENTION

The object of the present invention is to provide a simple and cost effective generic printing unit having a compact construction with long slide guides for accommodating wide slides.

The present invention is a printing unit for a web-fed rotary printing machine having at least one carrying wall, a plurality of cylinders mounted on the carrying wall, a drive motor corresponding to each cylinder and a slide corresponding to each cylinder. Each slide carries its corresponding cylinder and receives the corresponding drive motor. A drive means is provided for driving the slides and a plurality of guide elements are mounted on the carrying wall and arranged laterally next to the adjacent end faces of the cylinders for guiding the slides along the wall. The guide elements are arranged opposite and parallel to one another on the carrying wall.

Advantageously, the carrying wall includes panels defining an orifice to allow cylinders, journals and sleeves of the printing machine of varying sizes to be changed readily through the orifice.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

Embodiments of the present invention are illustrated in schematic form as follows.

DETAILED DESCRIPTION OF THE PRESENTLY PREFERRED EMBODIMENTS

Figure 1:
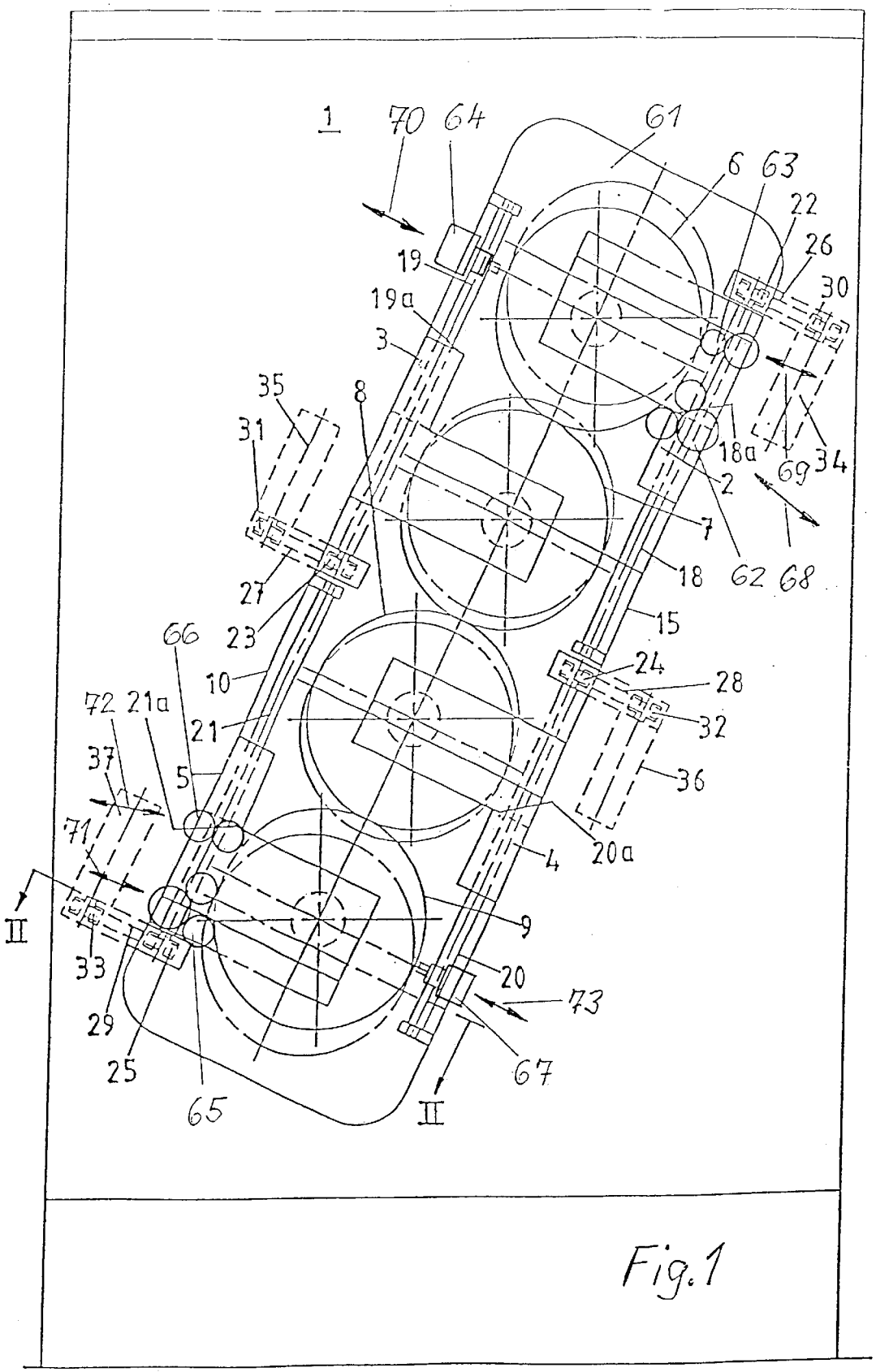
FIG. 1 is a side view of a printing unit of the present invention.

Referring now to FIG. 1, a printing unit of the present invention has a carrying wall 1 which is designed as a wall, framework or the like and on which identically designed slides 2 to 5 are guided. The identical design of the slides 2 to 5 affords simplification in terms of production. Each slide 2 to 5 carries a printing unit cylinder 6 to 9 and receives a drive motor, not illustrated here, for its printing unit cylinder. The carrying wall I is arranged laterally next to the end faces 11 of the printing unit cylinders 6 to 9. Drive motors of the type mentioned above are illustrated in FIG. 5.

Figure 2:
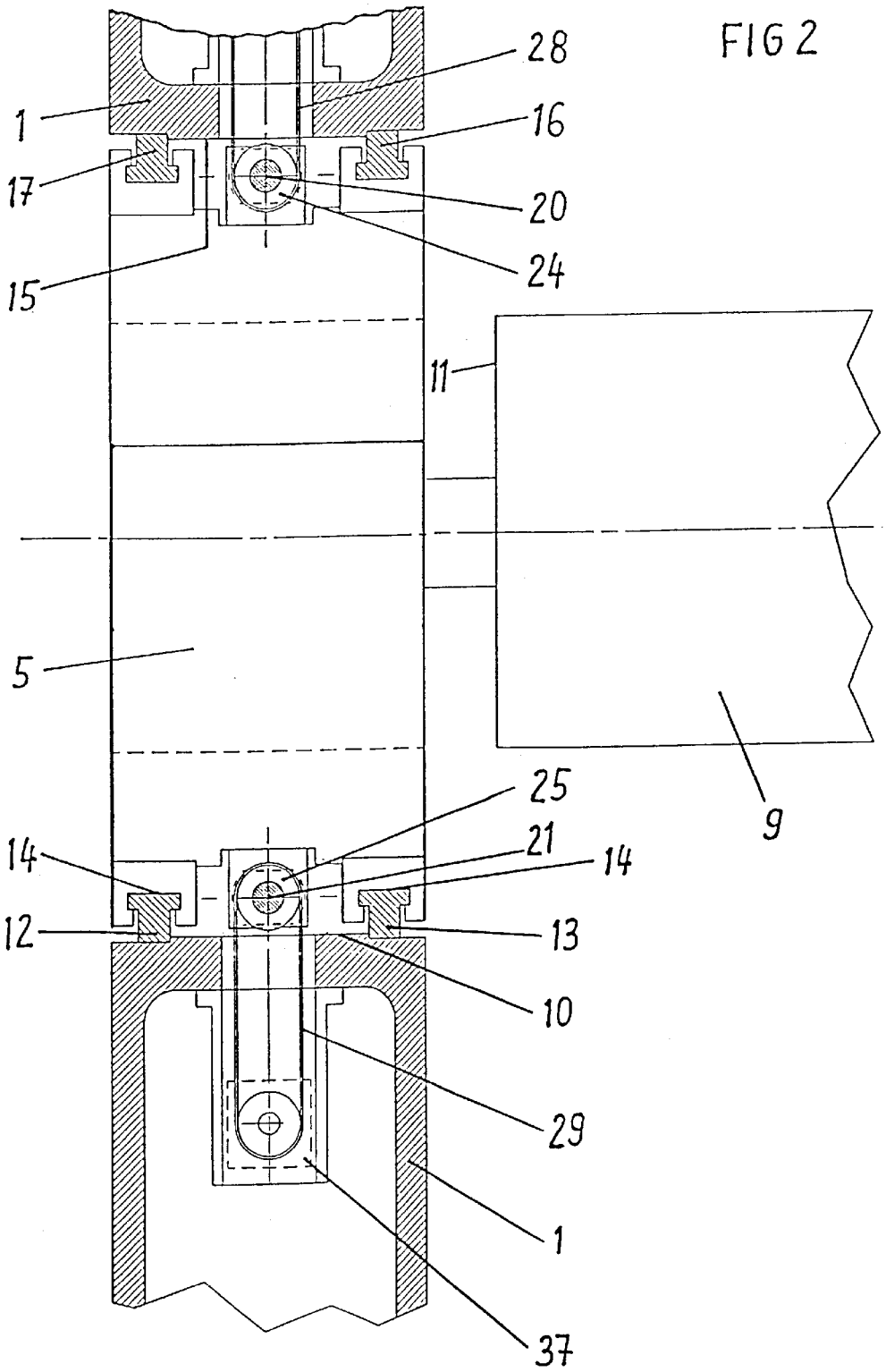
FIG. 2 is a sectional view along the line II—II of FIG. 1.

Referring now to FIG. 2, in an embodiment of the present invention, a panel 10 for the carrying wall 1 guides the slide 5. The panel runs perpendicularly to a plane through the end face 11 of the printing unit cylinder 9 and carries two guide elements 12, 13. The straight guide elements 12, 13, are rails, have a T-shaped cross section to provide positive slide guidance. The crosshead of each T-shaped cross section engages into a correspondingly designed undercut groove 14 on the slide 5.

A further panel 15 is provided on the carrying wall 1 parallel to the panel 10. Panel 15 also carries straight guide elements 16, 17 in the form of a rail and having a T-shaped cross section. The panels 10, 15 are mutually opposite parts of an orifice 61 in the carrying wall 1. This orifice 61 may also be designed, for example, as an open slot. Furthermore, a threaded spindle 18 to 21 is mounted rotably, but axially non-displaceably, for each printing unit cylinder 6, 8 and 7, 9 on the two panels 10, 15. The identically designed guide elements 12, 13, 16, 17 and the threaded spindles 18 to 21 are positioned so that the slides 3 and 5 for the printing unit cylinder 7 and 9 are guided on the panel 10 and the slides 2 and 4 for the printing unit cylinder 6 and 8 are guided on the panel 15. The slides of mutually cooperating successive printing unit cylinders are thus arranged alternately on the mutually opposite panels 10 and 15. As a result of this offset arrangement of the slides 2 to 5 assigned to the printing unit cylinders 6 to 9, the threaded spindles 18 to 21 and the guide elements, for example 12, 13, 16, 17, can be made long. This affords the possibility of also making the grooves, for example 14, by means of which the slides, for example 5, are guided, long as well. As a result of this design, the slides 2 to 5 can more efficiently absorb forces and moments, which occur during operation. Due to the arrangement of the guide elements 12, 13, 16, 17 on the panels 10, 15, direct vertical supporting forces for the printing unit cylinders 69 are introduced into the carrying wall I in its longitudinal direction. The support is therefore highly rigid and has low vibration which is a precondition for good printing quality. High forces may be applied. The apparatus can be made in a simple way in terms of design and is therefore cost effective to produce. Thus, for example, the guide elements 12, 13, 16, 17 can be made using commercially available straight guides. The guide elements 12, 13 and 16, 17 may be designed as continuous guide rails on the panel 10 or 15, while the slides 3, 5 and 2, 4 are equipped with counter rails.

Each threaded spindle 18 to 21 engages into a threaded nut 18*a* to 21*a*, indicated in FIG. 1, which is arranged fixedly in each slide 2 to 5. A gearwheel 22 to 25 is attached fixedly onto the end of each threaded spindle 18 to 21. Each gearwheel is connected via a countershaft 26 to 29, for example in the form of a chain mechanism or belt mechanism, to a further gearwheel 30 to 33 which is attached onto the output shaft of a servomotor 34 to 37 mounted on the carrying wall 1. The servomotors are preferably electric motors which are permanently mounted to the carrying wall 1. As mentioned, a belt mechanism with internal toothing could also be used instead of a chain mechanism.

FIG. 1 shows the printing unit cylinders 6 to 9 in the "print-on" position. In the "print-off position", the printing unit cylinders 6 and 7 are moved upwards and the printing unit cylinders 8 and 9 downwards, so that all the cylinders are lifted off of one another. This allows for changes to be made to the printing machine, such as changing the sleeves on the two outer printing unit cylinders 6 and 9. This is indicated by broken lines in FIG. 1.

Figure 3:
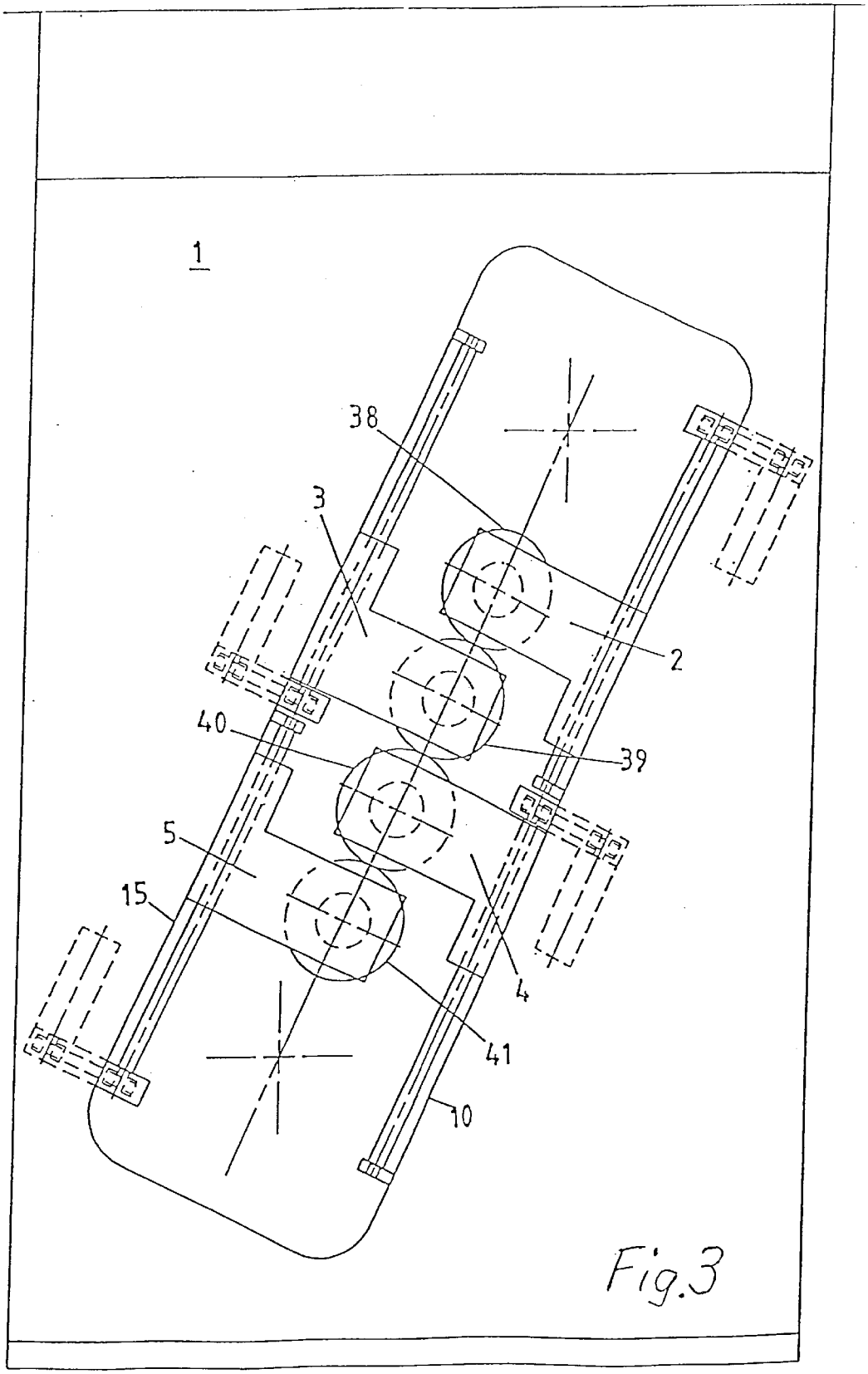
FIG. 3 is an illustration of a printing unit of the present invention corresponding to that of FIG. 1 having printing unit cylinders of differing diameter.

FIG. 3 shows that the slides 2 to 5 may also be equipped with printing unit cylinders 38 to 41 of smaller diameter. The invention therefore affords the advantage that, by means of an identically designed carrying wall 1 and identically designed slides and slide guides, printing units with printing unit cylinders of different diameter can be produced.

FIG. 1 also shows diagrammatically additional devices necessary for printing. On the form cylinder 6, an inking unit 62, a damping unit 63 and an imaging device 64 are shown. Similarly, on the form cylinder 9, an inking unit 65, a damping unit 66 and an imaging device 67 are shown. These additional printing devices may be placed onto the respective form cylinder 6, 9 by means of a movement device 68 to 73. The movement device can adjust the position of the additional devices 62 to 67 onto form cylinders having a different diameter as well as the different positions of the cylinders with respect to one another. Movement devices are shown for example, in German patent application No. PB 04405 the disclosure of which is herein incorporated by reference in the present application. Additional devices, such as erasing devices, rubber-blanket devices, and the like may also be provided. Moreover, the form cylinders 6, 9 are moveable on the guides 12, 13 and 15, 16 into the region of the respective imaging device 64, 67 for imaging purposes.

Figure 4:
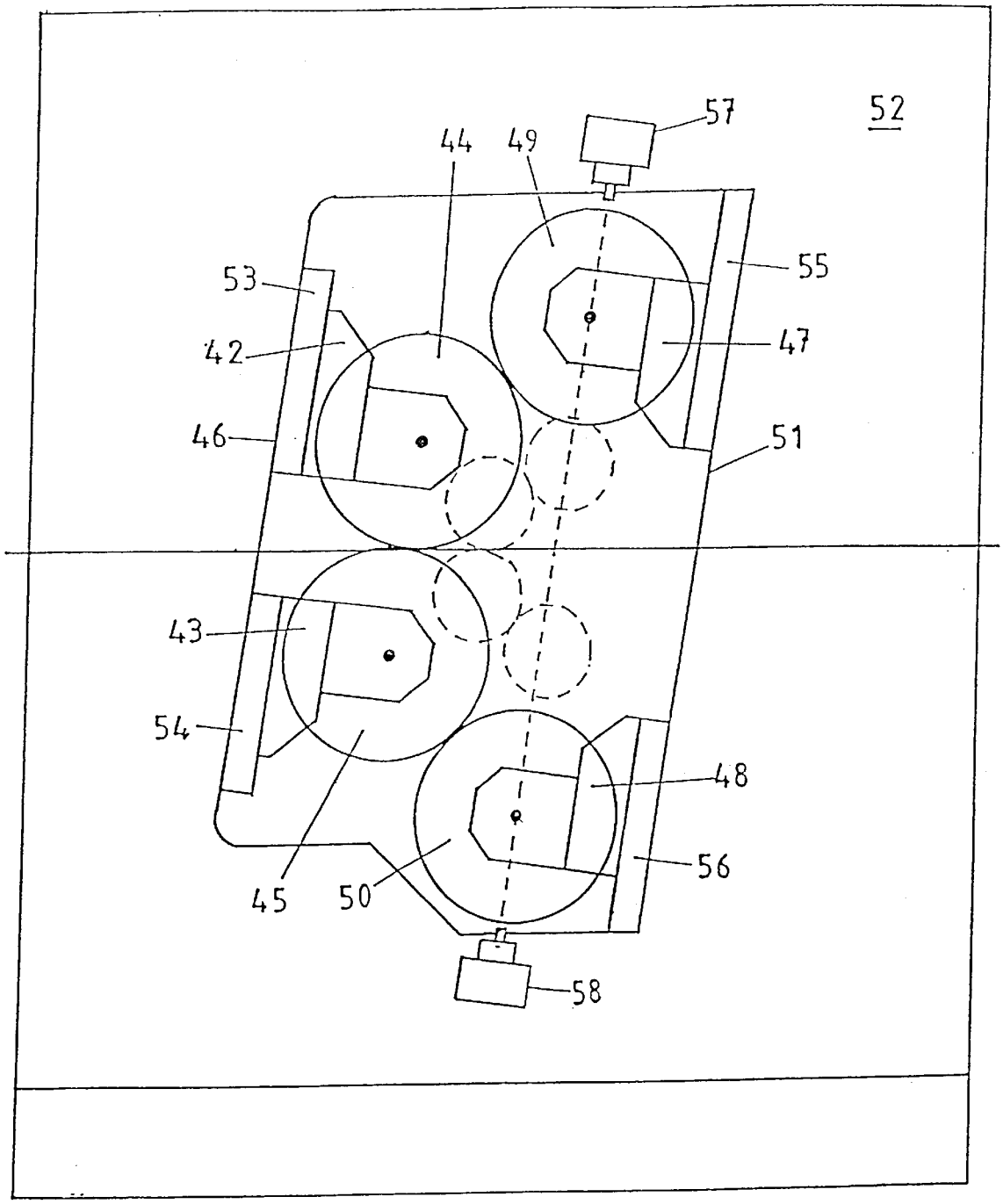
FIG. 4 is an illustration of a second embodiment corresponding to that of FIG. 1.

Referring now to FIG. 4, a further embodiment of the present invention is shown. The guide elements 53, 54 of the two slides 42, 43 for the inner printing unit cylinders 44, 45 are arranged on a panel 46. The guide elements 55, 56 of the two slides 47, 48 for the two outer printing unit cylinders 49, 50 are arranged on the parallel and opposite panel 51 of a carrying wall 52. The drive for the slides 42, 43, 47, 48 is designed in the same way as in the case of the first embodiment and is therefore not illustrated. In this embodiment, too, it is possible to use slides that extend. far enough in the direction of adjustment for using printing unit cylinders of different diameter. This is indicated by broken lines. In this case, a change in diameter is possible without the size of the slide having to be changed.

In the extreme case indicated in FIG. 4, the slides 42, 43 assigned to the inner printing unit cylinders 44, 45 must be exchanged for higher slides. In contrast, the slides 47, 48 assigned to the outer printing unit cylinders 49, 50 may be retained. This ensures that imaging devices indicated at 57, 58, which are assigned to the outer printing unit cylinders 49, 50 (i.e. form cylinders) and the optical axis of the imaging devices (which is to be coplanar with the axis of the associated form cylinder), do not have to be adjusted in terms of the distance from the guide elements 55, 56. Since the imaging devices may at all times be the same distance from the guide elements 55, 56, the imaging devices 57, 58 may be arranged in a stationary manner.

However, the imaging devices 57, 58 may also be movable toward the respectively associated cylinder. The imaging device is moveable with respect to the associated form cylinder 49, 50. It is preferable for the imaging device to move in the direction of movement of the form cylinder. Alternatively, the form cylinder 49, 50 may be moveable with respect to the imaging device in the working direction of the latter, that is to say the imaging direction.

Preferably, for this purpose, the imaging devices 57, 58 are moveable on the guide elements 55, 56 of the respectively associated cylinders 49, 50. For this purpose, the guide elements 55, 56 preferably extend as far as the imaging devices 57, 58. It would also be possible for further additional or auxiliary devices required for printing, such as inking and/or damping units, to be moveably arranged on the guide elements 55, 56. As a result, the device may be moved up to the associated cylinder. The moveable auxiliary or additional devices are assigned suitable drive means in the form. of servomotors and the like.

The mobility of the form cylinder 49, 50 towards the auxiliary devices, such as the imaging devices 57, 58 here, and of the latter towards the associated form cylinders 49, 50 ensures very high format variability. In the case of imaging devices 57, 58, as depicted, the mutual adjustment of cylinder and imaging device takes place in the imaging direction, i.e., in the direction of the optical axis of the imaging device. Despite high format variability, only one guide element is required, on which both the form cylinders 49, 50 and the associated additional device can be moved.

In the embodiments described above, the printing unit cylinders are mounted in an overhang manner. However, they may also be mounted at both ends in a slide. A second carrying wall must then be provided, equipped with guide elements and threaded spindles in a manner similar to the carrying wall 1. This second carrying wall may then be designed to be capable of being swung down or of being moved in the longitudinal direction of the cylinders for the purpose of changing a sleeve or a cylinder, as described in the German patent application no. DE 199 37 796.0.

Figure 5:
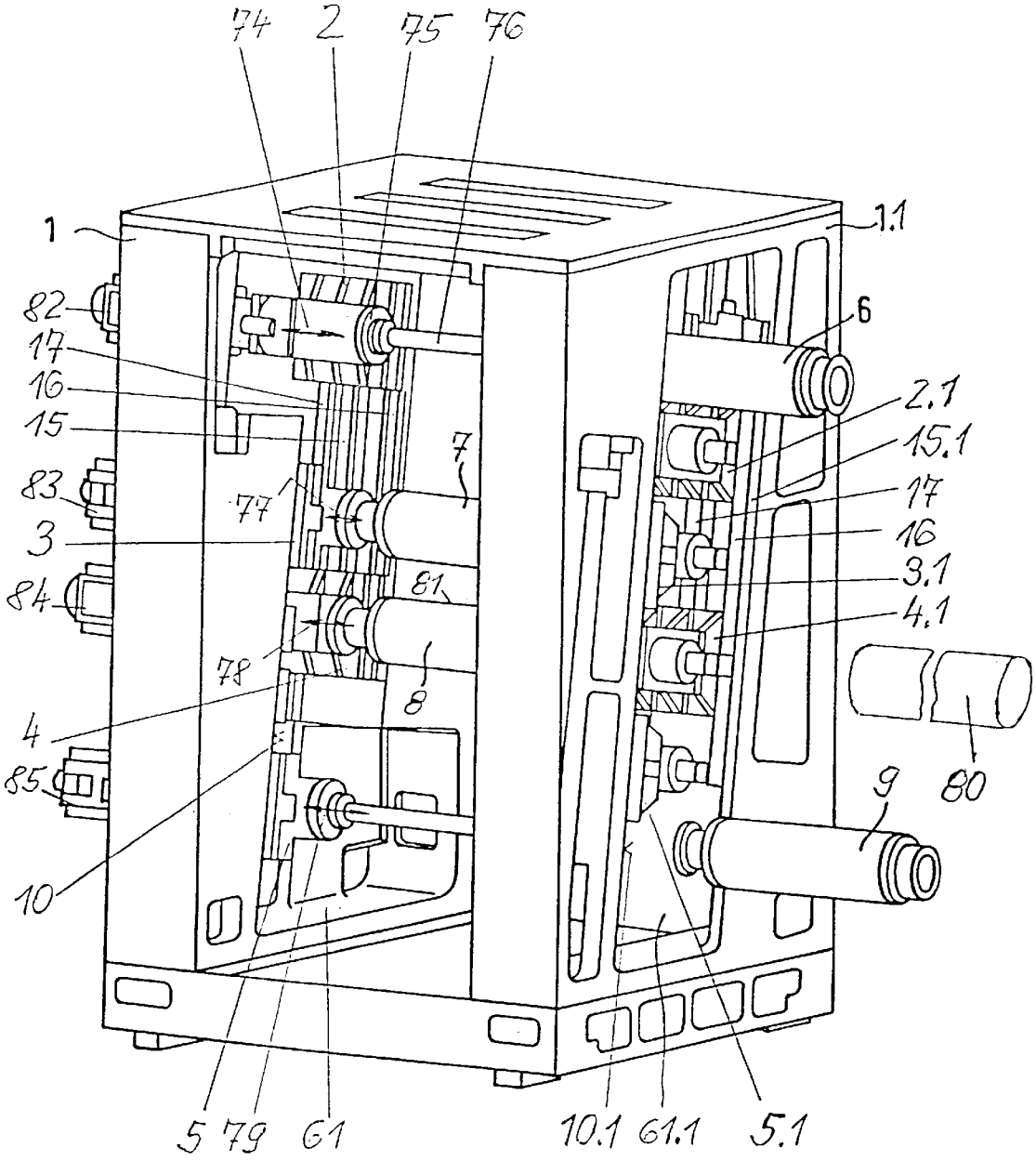
FIG. 5 is a perspective view of a further embodiment of the present invention having two carrying walls.

An embodiment of a printing unit having two carrying walls is shown in FIG. 5. This printing unit resembles the printing unit according to FIG. 1 in terms of the cylinder arrangement, and therefore, for the sake of simplicity, the same reference symbols are used for recurring components. Furthermore, reference numerals which are essentially identical or are identified by the addition "0.1" are used for equivalent parts. The printing unit contains two carrying walls 1 and 1.1, in which the printing unit cylinders 6 to 9 are mounted. This is therefore a two-sided mounting. As in FIG. 1, the printing unit cylinders 6 to 9 are mounted on one side in the slides 2 to 5 which are guided on the guide elements 12, 13 of the panel 10 (neither can be seen) and on the guide elements 16, 17 of the panel 15. On their other side, the printing unit cylinders 6 to 9 are mounted in identical slides 2.1 to 5.1. These slides 2.1 to 5.1 are guided by means of guides of the panel 10.1 (cannot be seen) and guides 16, 17 on the panel 15.1 of the carrying wall 1.1.

In order to change a printing unit cylinder 6 to 9 or tension-mount a printing plate on one of these cylinders, the respective printing unit cylinder is exposed on the side facing the carrying wall 1.1. In FIG. 5, these are the form cylinders 6, 9. For this purpose, the journal mounted in the slide 2.1 is separated from the associated form cylinder 6, by moving the form cylinder axially away from the journal by using a displacement device 74. Such a separation of the journal and form cylinder 6 is described in German patent document no. DE 198 48 184.5. The slide 2.1, together with the journal, is then moved downwards out of the region of the form cylinder 6 into the position depicted in FIG. 5. At the same time, the form cylinder 6 can be moved further upwards by means of the slide 2, as shown in FIG. 5, in order to place the form cylinder 6 and the slide 2.1 at a sufficient distance from one another. The form cylinder 6 is then extracted from the printing unit through the orifice 61.1 in the carrying wall 1.1. In this embodiment, the form cylinder 6 is of a type in which only the cylinder body is drawn off from the drive journal 75 mounted in the slide 2. In this case, the form cylinder 6 is first displaced axially on a rod 76 of the drive journal 75. Subsequently, in reverse order, another form cylinder 6, for example also with a different diameter, can be introduced through the orifice 61.1 into the printing unit. In this case, the slide 2.1 is moved upwards, until its journal is in line with the form cylinder 6. Thereafter, by means of the displacement device 74, the form cylinder 6 is moved up to the journal located in the slide 2.1 and is connected to the journal. The further printing unit cylinders 7 to 9 can also be exposed in the same way, and these cylinders are likewise equipped with displacement devices 77 to 79.

FIG. 5 also shows the form cylinder 9 in an extraction position. Furthermore, a rubber blanket sleeve 80 is illustrated. After exposure of the printing unit cylinder 8 (designed as a transfer cylinder) and removal of the rubber blanket sleeve 81 located on the cylinder, the sleeve 80 can be pushed through the orifice 61.1 onto the transverse cylinder 8.

In the examples described above, the print carrying web is guided approximately horizontally, as indicated at 59 in FIG. 4. The printing units according to the invention may, however, also be designed for a vertical run of the web 59 by virtue of a rotated arrangement of the guide elements through about 90°.

The present invention is not restricted to the embodiments illustrated. Thus, for example, it would also be possible to provide the slides for the pairs of cylinders respectively belonging together, which contain a form cylinder and a transverse cylinder adjacent to the latter, in each case on the same panel 10, 46 or 15, 51 of the carrying wall 1, 52.

In the exemplary embodiments, the guide elements 12, 13, 16, 17, 53 to 56 on the mutually opposite panels 10, 15, 10.1, 15.1, 46, 51 are advantageously parallel to one another. They may, however, also be arranged so as to deviate from the parallel, in which case, however, the ratios of advance of the printing unit cylinders 6 to 9, 44, 45, 49, 50 cannot then be implemented identically to the adjusting movements of the slides 2 to 5, 2.1 to 5.1, 42, 43, 47, 48.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. It is the intention, therefore, to be limited only as indicated by the scope of the claims appended hereto.

We claim:

1. A printing unit for a web-fed rotary printing machine, comprising:

first carrying wall having a single orifice with two opposite panels;

four cylinders mounted on the first carrying wall at the single orifice so as to be radially displacable in a common direction;

a drive motor corresponding to each cylinder;

a slide corresponding to each cylinder, wherein each slide carries its corresponding cylinder and receives the corresponding drive motor;

drive means for driving the slides; and a plurality of straight guide elements mounted on the first carrying wall and arranged laterally next to adjacent end faces of the cylinders for guiding the slides along the first wall so that all the cylinders are mounted to the first carrying wall, wherein the guide elements are arranged opposite and parallel to one another on the mutually opposite panels of the orifice of the first carrying wall.

2. The printing unit according to claim 1, wherein the two panels face one another and run parallel to an axis of the cylinders, wherein the guide elements are arranged on the panels for adjusting the slides.

3. The printing unit according to claim 1, further comprising a second carrying wall, one of the carrying walls being arranged at a front of each of two end faces of the cylinders.

4. The printing unit according to claim 1, wherein the two panels face one another and run parallel to an axis of the cylinders, and wherein the guide element and the drive means for the slides of adjacent cylinders are mounted alternately on the two panels.

5. The printing unit according to claim 1, wherein the two panels face one another and run parallel to an axis of the cylinders, and wherein the cylinders comprise two inner cylinders and two outer cylinders, the two inner cylinders being guided on one of the panels and the two outer cylinders being guided on another of the two panels.

6. The printing unit according to claim 1, wherein the guide elements comprise straight guide rails.

7. The printing unit according to claim 1, wherein the cylinders comprise at least one form cylinder, and further comprising:

at least one auxiliary printing device moveable in a direction of movement of the form cylinder.

8. The printing, unit according to claim 7, wherein the auxiliary device comprises an imaging device having an optical axis that is parallel to a guide plane of the corresponding guide element.

9. The printing unit according to claim 1, wherein the of cylinders comprises at least one outer form cylinder, and further comprising:

at least one auxiliary printing device, wherein the form cylinder is movable in a working direction of the auxiliary printing device.

10. The printing unit according to claim 9, wherein the auxiliary printing device comprises an imaging device and the working direction is in an imaging direction of the imaging device.

11. The printing unit according to claim 1, wherein at least one of the cylinders is a form cylinder, and further comprising:

at least one auxiliary printing device, wherein the form cylinder is moveable on the guide element toward the auxiliary printing device.

12. The printing unit according to claim 11, wherein each guide element for the form cylinder extends far enough to accommodate the auxiliary printing device.

13. The printing unit according to claim 12, wherein the auxiliary printing device is also moveable on the corresponding guide element.

14. The printing unit according to claim 1, wherein each slide comprises a fixedly inserted threaded nut into which a threaded spindle engages, and wherein the drive means comprises a servomotor drivingly associated with each spindle.

15. The printing unit according to claim 14, wherein each threaded spindle is rotatably mounted and axially fixed on the carrying wall.

16. The printing unit according to claim 14, wherein the servomotors are fastened to the carrying wall.

17. The printing unit according to claim 1, wherein the mutually opposite guide elements are parallel to one another.

18. The printing unit according to claim 1, wherein the slides and their corresponding drive means of adjacent cylinders are placed opposite one another on the panels.

19. The printing unit according to claim 1, wherein two inner cylinders and two outer cylinders are provided, the slides and the corresponding drive means of the two inner cylinders being parallel to the slides and the corresponding drive means of the two outer cylinders.

20. The printing unit according to claim 1, wherein the cylinders comprise at least one form cylinder, and further comprising:

at least one auxiliary printing device assigned to the form cylinder; and movement means for placing the auxiliary printing device onto the form cylinder.

21. The printing unit according to claim 20, wherein the auxiliary printing device comprises an inking unit.

22. The printing unit according to claim 20, wherein the auxiliary printing device comprises a damping unit.

23. The printing unit according to claim 20, wherein the auxiliary printing device comprises an imaging device.

24. The printing unit according to claim 23, wherein the form cylinder is moveable on the guide elements into a region of the imaging device.

25. The printing unit according to claim 1, wherein two carrying walls are provided, and further comprising:

a journal removably mounted on at least one of the cylinders, wherein at least one slide corresponding to the journal mounted cylinder is moveable on the guide elements out of a region occupied by the journal mounted cylinder.

26. The printing unit according to claim 25, wherein each carrying wall has two opposite panels each having an orifice and the guide elements are arranged on the mutually opposite panels to allow the cylinders to be exposed on a side whereby the cylinders can be extracted from the printing unit on the exposed side through the orifice of the carrying wall and can be exchanged for a cylinder having a different diameter.

27. The printing unit according to claim 26, further comprising:

a sleeve-like tension mounted covering on the cylinders, wherein the covering can be extracted from the exposed cylinders on the exposed side through the orifice of the carrying wall and can be exchanged for a different tension mounted covering.

* * * * *